US006766976B2

(12) United States Patent
Salåker et al.

(10) Patent No.: US 6,766,976 B2
(45) Date of Patent: Jul. 27, 2004

(54) DISPENSER FOR ROLLS OF WEB MATERIAL

(75) Inventors: Allan Salåker, Vikmanshyttan (SE); Christina Wester, Säter (SE); Mats Lind, Hedemora (SE)

(73) Assignee: SCA Hygiene Products AB, Gothenburg (SE)

( * ) Notice: Subject to any disclaimer, the term of this patent is extended or adjusted under 35 U.S.C. 154(b) by 26 days.

(21) Appl. No.: 10/254,649

(22) Filed: Sep. 26, 2002

(65) Prior Publication Data

US 2003/0071163 A1 Apr. 17, 2003

Related U.S. Application Data

(60) Provisional application No. 60/324,513, filed on Sep. 26, 2001.

(51) Int. Cl.[7] ..... B65H 19/00
(52) U.S. Cl. ..... 242/560.3
(58) Field of Search ..... 242/560.3; 312/34.22

(56) References Cited

U.S. PATENT DOCUMENTS

| | | | |
|---|---|---|---|
| 2,840,319 | A | 6/1958 | Danko |
| 4,098,469 | A | 7/1978 | McCarthy |
| 4,422,584 | A | 12/1983 | Dashnier et al. |
| 5,449,127 | A | 9/1995 | Davis |
| 6,092,451 | A | 7/2000 | Granger |

FOREIGN PATENT DOCUMENTS

| | | |
|---|---|---|
| EP | 1 155 650 A1 | 11/2001 |
| FR | 2 715 289 | 7/1995 |

*Primary Examiner*—John Q. Nguyen
(74) *Attorney, Agent, or Firm*—Young & Thompson

(57) ABSTRACT

Dispenser for rolls of material in the form of a web has a withdrawal opening for the material and space for at least two rolls. A first space is arranged adjacent to the withdrawal opening and is intended for a roll in use position, and a second space is intended for a roll in reserve position. A retaining member is arranged so as, in a retaining position, to hold the second roll in reserve position, and to be freed in order to allow the reserve roll to drop down into use position when the first roll is removed. A spindle end arranged in the first space is displaceable in its longitudinal direction and rotatably mounted. It is intended to lie in engagement with the interior of a central core of a roll in use position and is connected to an operating knob arranged outside the housing for feeding out the material web and for drawing the spindle end out of engagement with the central core. When the spindle end is drawn out of engagement with the central core of a roll in use position, the retaining member is freed. When the spindle end is brought into engagement with the interior of the central core of a new roll in use position, the retaining member is brought back into retaining position.

10 Claims, 3 Drawing Sheets

DISPENSER FOR ROLLS OF WEB MATERIAL

TECHNICAL FIELD

The present invention relates to a dispenser for rolls of material in the form of a web, such as paper, non-woven fabric, or film or foil, which dispenser comprises a housing with a withdrawal opening arranged at the bottom for the material in the form of a web, the housing having space for at least two rolls which are arranged with their centre axes lying essentially horizontally, a first space being arranged adjacent to the withdrawal opening and being intended for a roll in use position, and a second space being located above the first space and being intended for a roll in reserve position, in addition to which a retaining means is arranged so as, in a retaining position, to hold the second roll in reserve position, the retaining means being arranged so as to be freed in order to allow the reserve roll to drop down into use position when the first roll is removed.

BACKGROUND ART

Dispensers of this type, for example for rolls of toilet paper, are intended for two or more rolls, one roll being in use position and other rolls in reserve position, and the latter being moved into use position when the preceding roll is finished and its empty core is removed from the dispenser.

A common problem in public toilets where the paper consumption is great is that it is difficult for service personnel to manage to replenish paper before there is none left in the containers. Rolls of paper which are placed loosely in reserve are often stolen, and this solution does not work in practice. The problem is an old one, and a great many solutions have been proposed over the years. Some examples of previously known dispensers for a number of rolls of a material in the form of a web are mentioned below.

U.S. Pat. No. 3,865,295 discloses a toilet paper dispenser where the rolls are each slipped onto a wooden rod which runs in grooves in the wall of the dispenser and can be hung on a pendulum-type mechanism. On roll exchange, the user guides a lever on the pendulum-type mechanism backwards in such a way that on the one hand the core and wooden rod of the lower roll are freed and drop down into a storage space and on the other hand the roll above can drop down into use position for feeding out paper. This dispenser therefore requires separate wooden rods for suspending the rolls in the dispenser. Furthermore, the mechanism as a whole is particularly complicated.

U.S. Pat. No. 2,299,301 and U.S. Pat. No. 2,767,930 and also U.S. Pat. No. 4,203,562 likewise describe very complicated mechanisms with link arms or grooves.

CH-A-404 124 describes a somewhat simpler but still relatively complicated mechanism using levers and pendulum-type arrangements. A roll in reserve position is held in place by two opposite projecting support arms, each on its own pendulum-type arrangement, arranged on either side of the roll. The pivoting spindles of these are arranged on levers which are held in place by a roll in use position. When a roll in use position is finished and its core is taken out of the dispenser, the levers are freed and the weight of the roll in reserve position presses said support arms in a direction outwards from the inner space of the dispenser at the same time as the pivoting spindle of the pendulum-type arrangement is moved. The construction does not appear especially reliable, and there is a risk that the rolls will catch on the support arms on their way down from reserve position to use position.

U.S. Pat. No. 4,383,657 discloses a dispenser for two rolls of paper where the lower roll slides freely against the bottom of the dispenser housing and an inclined rear edge in such a way that it is advanced into feed-out position against a withdrawal opening provided with a tearing edge. The upper roll is prevented from dropping down by the upper part of a lever. On roll exchange, the user presses on the lower part of the lever, which is designed as a pressure plate. The empty core is then pressed through an opposite hole, and the stop lug at the top of the lever is moved aside in such a way that the upper roll can drop down.

EP-A-0 034 121 discloses a paper dispenser for a number of rolls arranged one above another, where the roll located in use position adjacent to the withdrawal opening rests on a rocking plate. When the roll is finished, it is possible, by pressing on a part of the rocking plate projecting from the withdrawal opening, to cause the latter to fold upwards, on the one hand the empty core being pressed out through the withdrawal opening and on the other hand a retaining device, which holds a roll in reserve position, being moved aside in such a way that the reserve roll can drop down into use position.

EP-A-0 298 931 and GB-A-2 193 703 likewise describe constructions which call for manual handling in order to bring a roll from reserve position into use position. It is common to both these mechanisms that the user inserts a hand into the inside of the container and takes hold of a lower lever arm of a two-armed lever and raises this, the upper lever arm being lifted upwards and taking the roll in reserve position upwards. The upper lever arm is short in relation to the lower, which means that the upper lever arm is, after a short pivoting movement of the lower, brought out of supporting engagement with the roll in reserve position. The roll can then drop down from reserve position into use position and bring the lower lever arm with it, which results in the upper lever arm being brought into its previous supporting position and being capable therein of supporting a new reserve roll.

Previously known constructions which call for manual handling by the user in order to bring a roll from reserve position into use position have not functioned satisfactorily in all respects. It is difficult to communicate in a sufficiently effective manner to ordinary users that a new roll can be brought into use position by inserting a hand into the dispenser and performing a special operation using a mechanism.

U.S. Pat. No. 2,839,346 describes an arrangement in which a roll in reserve position automatically drops down into use position when the empty core of a finished roll is taken out of the use position. This document discloses a dispenser for two rolls, where the reserve roll is held in place by a retaining means which is acted on by the lower roll which presses on a spring-loaded tongue. This tongue is connected firmly to an upwardly extending wire, the upper portion of which is arranged inside the side edge of a tippable stop washer for supporting it when the spring-loaded tongue is pressed in by a roll in use position. A roll in reserve position therefore rests on the stop washer. When a roll in use position is finished, and the empty core is removed, the tongue springs out and brings said wire out of engagement with the stop washer which then tips downwards and lets a roll down from the reserve position into the use position. The tongue then returns counter to the action of the spring, and the wire pivots back and lifts the stop washer into the support position, in which it can support a new reserve roll. In use position, the roll rests on two elongate rotatable rollers at the bottom of the dispenser housing.

The dispenser described in the last-mentioned publication includes a fragile mechanism which will not withstand the wear which occurs when dispensers are used in public toilets. It is also awkward and difficult to reach the empty core from the narrow withdrawal opening.

SE 512 595 describes a dispenser for a number of rolls, where a roll in use position is held in place between a casing (housing) and a spring-loaded dished plate which is provided with an edge flange running all the way round for supporting the roll in use position. Via a link arm, the dished plate controls a tippable support plate, the support plate being in a support position for supporting a reserve roll when the dished plate is loaded by a roll in use position, whereas the support plate tips for lowering a new roll from the reserve position into the use position when the empty core of the finished roll is removed from the use position and the spring is freed. The last-mentioned publication describes another embodiment where the retaining means which holds the reserve roll in place consists of a pair of support pins which form an integrated part with a holding means. The dished plate, which supports a roll in use position, is attached to said holding means which is therefore carried along when the dished plate is pivoted. The reserve roll is supported by said support pins as long as a roll or empty core is in place on the dished plate but, as soon as the empty core is removed, the dished plate, and the holding means acted on by it, will, in a manner corresponding to that described above, rock about its axis, the support pins being moved in a direction towards the rear plate and out of engagement with the reserve roll which then drops down into use position in the dished plate.

As wear is great in a public environment, the construction of the dispensers has to be robust and reliable. These requirements are especially important when these are dispensers for large, heavy rolls of paper which drop from reserve position into use position and moreover have to be handled in the dispenser.

One object of the present invention is to produce a dispenser which is more robust and operationally reliable than previously known solutions and which moreover is easier to handle.

Many demands are made of dispensers intended for a number of rolls and for a public environment, such as busy toilets.

The way in which the reserve roll is brought into active position should be both simple and obvious. The way in which the empty core of a finished roll is taken out in order to cause the reserve roll to be brought into use position should therefore be simple and obvious.

Another problem to which attention is not always paid is that it must be easy to reach the end of the material on a new roll. On a roll of paper, for example, the outermost turns are usually joined together in order that the roll can be handled before use, and it must therefore be easy to rotate the roll from the outside and to reach the roll of paper via the withdrawal opening in order to free the end of the material web of the roll.

At the same time, it is important that it is not possible to take out a roll of paper which contains a large number of turns.

There is also a need for dispensers in which the material web can be fed out simply via an operating means accessible from the outside.

Above, and below as well, reference is frequently made to paper, but it must be pointed out here that the present invention is not limited to dispensers for paper but is intended for all types of flexible material in the form of a web, such as plastic film or aluminium foil, non-woven fabric and paper.

DISCLOSURE OF INVENTION

By means of the present invention, a dispenser of the type referred to in the introduction has been produced, which is robust and operationally reliable and which moreover solves all the problems described above in connection with the description of known dispensers.

A dispenser according to the invention is characterized mainly in that a spindle end is arranged in the first space in the housing, which spindle end is displaceable in its longitudinal direction and rotatably mounted, is intended to lie in engagement with the interior of a central core of a roll in use position and is connected to an operating knob arranged outside the housing, by means of which knob the material web can be fed out of the withdrawal opening and by means of which the spindle end can be drawn out of engagement with the central core, and in that means are arranged so as to free the retaining means when the spindle end is drawn out of engagement with the central core of a roll in use position and to bring the retaining means back into retaining position when the spindle end is brought into engagement with the interior of the central core of a new roll in use position.

According to a suitable embodiment, the invention is characterized in that said means include a rocking means which is arranged around the spindle end and arranged rockably about a horizontal rocking pin extending at right angles to said spindle end, in that the upper part of the rocking means is arranged so as to be taken along in a rocking movement by the spindle end when the latter is drawn out of engagement with the central core, and in that the upper part of the rocking means is arranged so as to interact with a link mechanism which is in turn arranged so as to free the retaining means when said drawing-out of the spindle end takes place and to lock the retaining means again when the spindle end is guided into engagement with the interior of the core of a roll arranged in the use position.

According to a suitable embodiment, the invention is characterized in that the rocking means has on its lower part a locking heel which projects in the direction of a roll arranged in use position and is arranged so as to interact with a roll in use position, one edge side of the roll limiting, until the roll is virtually finished, the pivoting of the rocking means when the locking heel strikes against said edge side of the roll, and in that said locking heel is arranged so as to prevent said rocking movement and thus the drawing of the spindle end out of the core of the roll in use position until the roll is virtually finished and the locking heel has space to pass in under the virtually finished roll.

According to one embodiment, the invention is characterized in that the spindle end is arranged so as to be drawn manually out of the core of a finished roll by means of the operating knob counter to the action of a spring, the latter being arranged so as automatically to guide the spindle end into engagement with the central core of a new roll introduced into use position.

According to another embodiment, the invention is characterized in that the spindle end has a portion which, when the spindle end is drawn out, strikes against the upper part of the rocking means and takes the latter along in said rocking movement.

According to another embodiment, the invention is characterized in that the locking heel is arranged so as to be pivotable downwards from its laterally projecting state in relation to the rest of the rocking means counter to the action of a spring, as a result of which the locking heel can be pivoted aside about its pivoting pin when it is acted on by the weight of a new roll of full size dropping down into the use position, and in that the locking heel is arranged so as, by virtue of the action of said spring, to return to its projecting state and in doing so rock the rocking means back out of engagement with the link mechanism when the spindle end is guided into engagement with the interior of the central core of the roll located in use position, the retaining means being arranged so as to return to retaining position to support a new roll in reserve position.

According to another embodiment, the dispenser according to the invention is characterized in that the link mechanism includes a link arm which is pivotable about a horizontal pin, is arranged so as by its upper end to support a locking catch and to hold the retaining means in retaining position and is arranged so as, counter to the action of a spring, to be brought out of engagement with the locking catch when the rocking means takes the lower end of the link arm along in a pivoting movement when the spindle end is drawn out of a core of a finished roll.

According to a further embodiment, the invention is characterized in that the retaining means is arranged so as, counter to the action of a spring, to drop like a trapdoor under the weight of a roll in reserve position when the link arm is brought out of engagement with the locking catch and, by virtue of the action of said spring, to return to its retaining position when the roll has dropped past the retaining means.

Further features and advantages of the invention will emerge from the patent claims below and the following description.

BRIEF DESCRIPTION OF DRAWINGS

The invention is described in greater detail below with reference to an illustrative embodiment shown in the accompanying drawings, in which.

Figure 1:
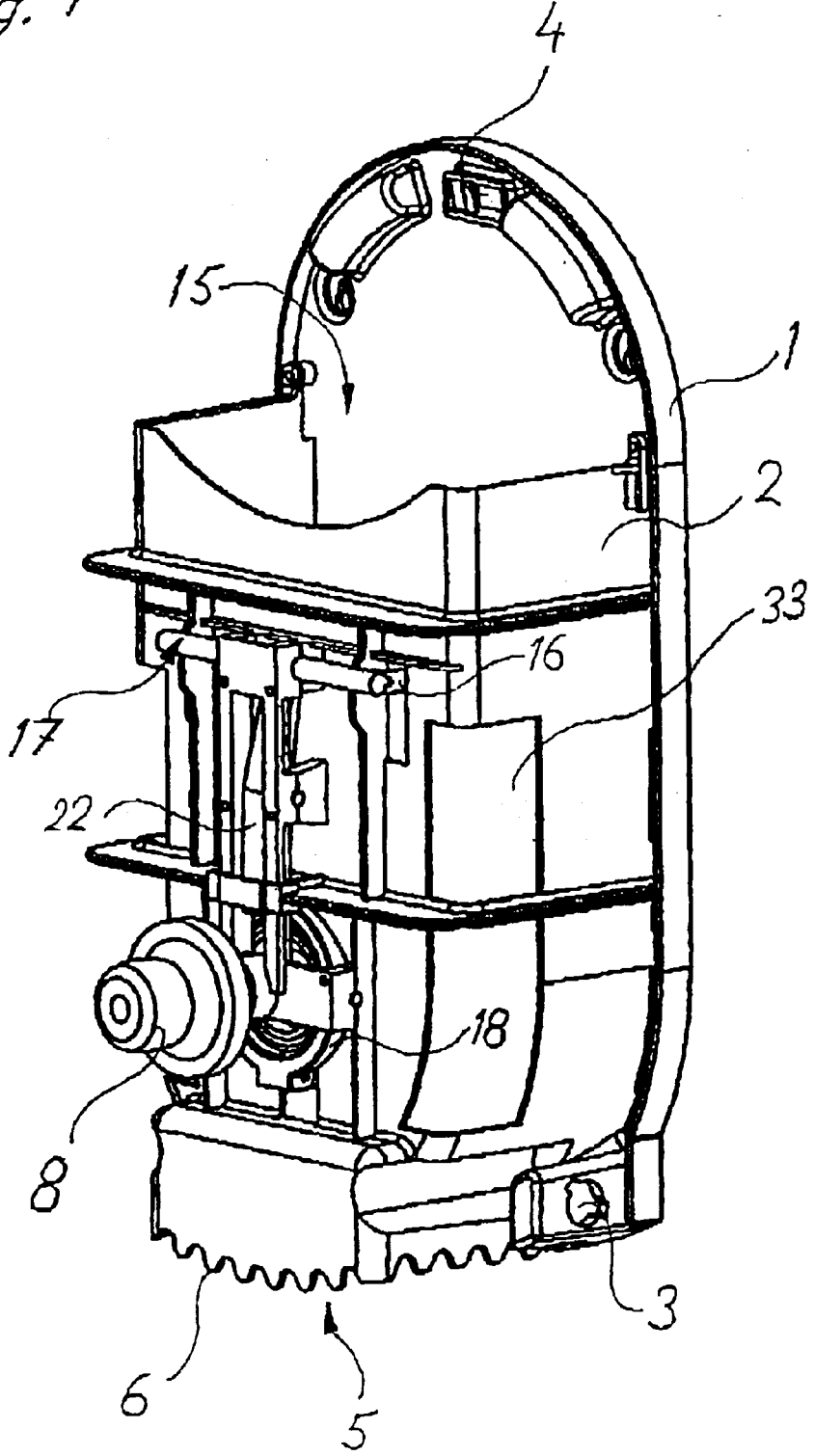
FIG. 1 shows a perspective view of a dispenser according to the invention with the outer cover removed.

The invention relates to a dispenser for rolls of material in the form of a web, which means all types of flexible material in the form of a web, for example plastic film or aluminium foil, non-woven fabric and paper. Reference will in the first place be made to paper below even though the invention is not limited to dispensers for paper. The paper can be in the form of a continuous web, the dispenser being provided with tearing teeth or another sharp tearing edge in order to cut off a certain length of the paper. The paper web can also be provided with perforations at a certain interval so as to allow a given length of the paper to be torn off from the roll.

In the first place, those rolls in which the paper is rolled up on a rigid core are intended, but it is also possible for the innermost turns of the paper web to form a stiffened core in the roll of paper, for example by being joined together by means of spraying with water, pasting or equivalent.

The dispenser according to the invention comprises a wall bracket 1, on which a casing 2 is mounted to form a dispenser housing. The dispenser also includes an openable outer cover, preferably made of transparent plastic. This cover, which has been omitted in the drawing for the sake of simplicity, consists of a hood which is mounted pivotably about a horizontal axis at 3 in FIG. 1 and is suitably lockable at 4 in order to prevent the theft of rolls of paper.

Figure 2:
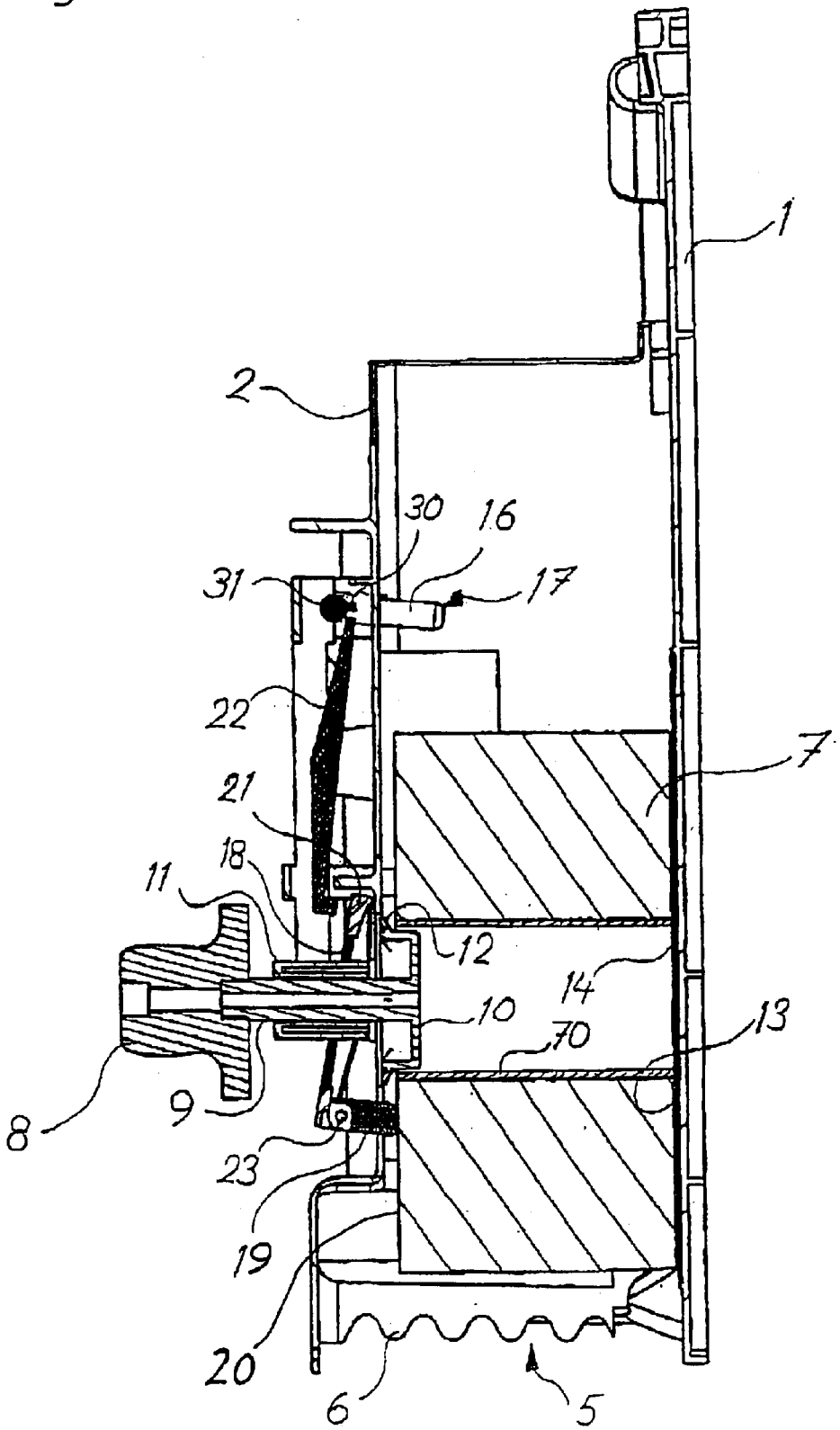
FIG. 2 shows diagrammatically a longitudinal section through the centre of a dispenser according to FIG. 1.

The housing formed by the wall bracket 1 and the casing 2 has a withdrawal opening 5 at the bottom, which has tearing teeth 6 along a number of edges, as can be seen from FIGS. 1 and 2. The housing has room for two rolls of paper, a first 7, as can be seen from FIG. 2, being arranged in a first space. This is arranged adjacent to the withdrawal opening 5. In use position, the roll of paper is arranged with its centre axis lying essentially horizontally and projecting straight out from the wall bracket 1.

The dispenser is provided with an operating knob 8 which, as can be seen from FIG. 2, is connected rigidly via a spindle 9 to a short spindle end 10. The spindle 9 is mounted rotatably and displaceably in a bearing sleeve 11 connected rigidly to the casing. The spindle end can therefore be both rotated and axially displaced by means of the operating knob 8. The spindle end 10 has a peripherally projecting bearing flange 12, the circumference of which is adapted to the interior of the central core 70 so that the spindle end can be inserted into the interior of the central core with the bearing flange in friction engagement with the interior of the central core 70.

When a roll of paper is in use position, it is supported by the spindle end, and one 13 of its edge sides bears against a smooth surface 14 of the wall bracket. This surface has low friction and can consist of, for example, a polished metal sheet.

FIG. 2 shows the operating knob in a slightly drawn-out position and with the bearing flange out of engagement with the central core of the roll. The operating knob can be drawn out counter to the action of a spring (not shown) arranged in the bearing sleeve 11, which spring is intended automatically to insert the spindle end into a roll in use position and bring the bearing flange into engagement with the interior of the core when the operating knob is released. When a roll is in use position and the spindle end is arranged in the interior of the core, the roll can be rotated by means of the operating knob to feed the paper web out through the withdrawal opening 5.

Rolls of paper are introduced into the dispenser via an opening 15. In addition to a roll in use position, the dispenser also accommodates a roll in reserve position. The reserve roll is supported by two support pins 16 of a retaining means designated as a whole by reference number 17.

A rocking means 18 in the form of a rocking ring is arranged around the bearing sleeve 11. When the spindle end 10 is inserted into the central core of a roll of paper in use position, the rocking means takes up the position shown in FIG. 2, in which a locking heel 19 is in engagement with one edge side 20 of the roll. In FIG. 2, the spindle end is partly drawn out of the roll by means of the operating knob 8. Continued drawing-out of the spindle end is prevented by the upper part 21 of the rocking means when the bearing flange strikes against this part and the roll of paper is full, as shown in FIG. 2. This is due to the fact that the rigid rocking means cannot rock counterclockwise because the locking heel 19 is in engagement with the edge side 20 of the roll. Only when the roll is virtually finished can the locking heel pass in under the roll and the rocking means rock counterclockwise when the operating knob is drawn out and brings the spindle end out of engagement with the core, the spindle end striking with the bearing flange 12 against the upper part 21 of the rocking means and taking this part along in a counterclockwise rocking movement.

The upper part 21 of the rocking means is arranged so as to interact with a link mechanism which is in turn arranged so as to free the retaining means 17 when said drawing-out of the spindle end is effected by means of the operating knob. In the illustrative embodiment shown, the link mechanism consists of a link arm 22. When the retaining means is freed, the support pins 16 drop downwards like a trapdoor, and the reserve roll which had rested on the support pins drops down into use position and in doing so ejects the core of the finished roll. The locking heel 19 can be pivoted down about a pin 23 counter to the action of a torsion spring. This is dimensioned in such a manner that the locking heel is folded down by virtue of the action of the weight of a new roll dropping down into use position, the empty core being ejected past the locking heel, and the new roll being allowed to pass into use position. When the new roll has dropped down into use position, the spindle end is inserted into the central core by the spring force in the spring arranged in the bearing sleeve, and the rocking means rocks back, the locking heel returning to its position shown in FIG. 2, and the retaining means returning to retaining position.

Figure 3:
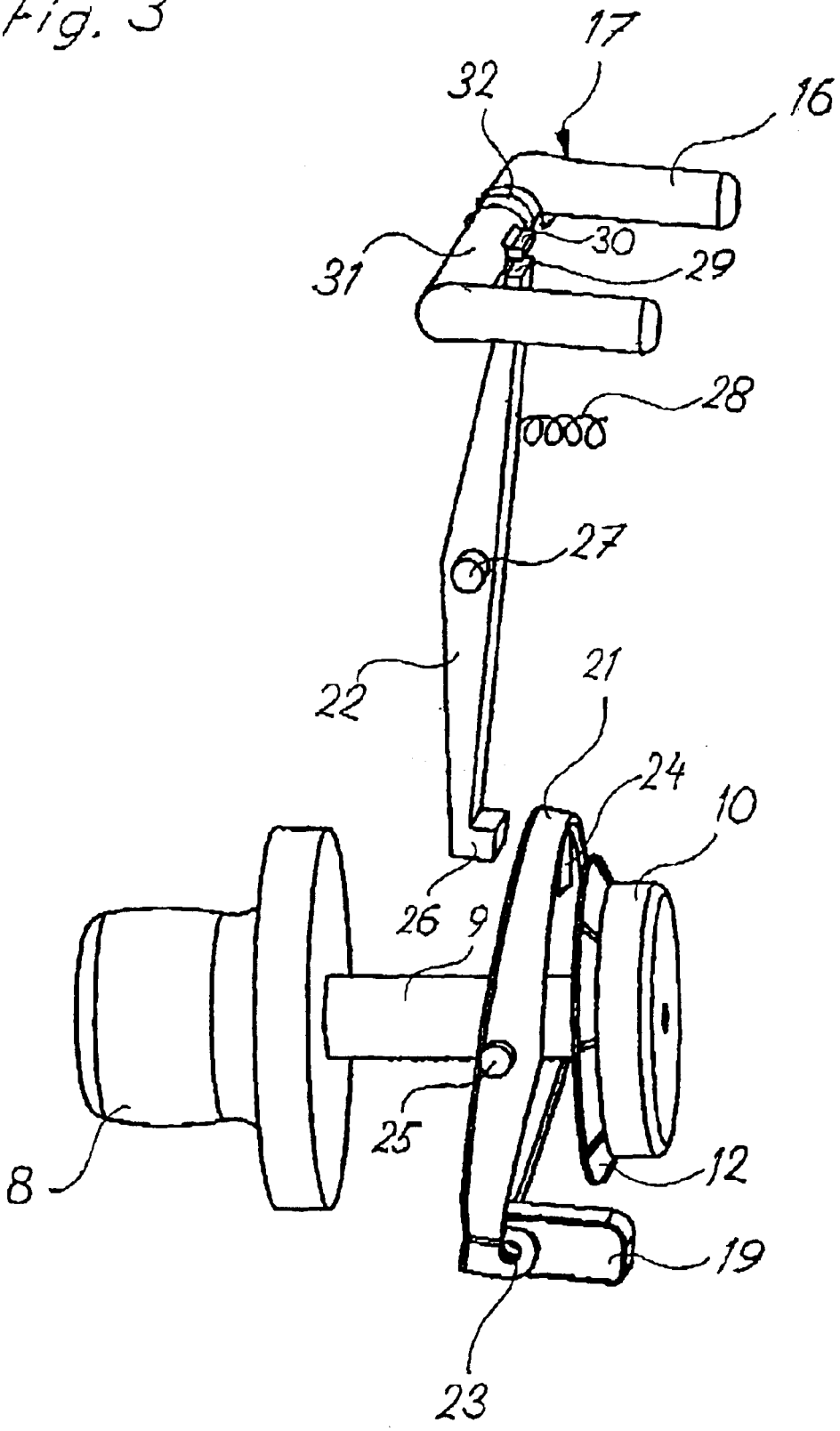
FIG. 3 shows an exploded diagram of some of the parts included in a dispenser according to FIGS. 1 and 2 to illustrate the invention.

The functioning of the moving parts for freeing the retaining means and returning the latter to retaining position is described below with reference to FIG. 3. In this figure, only the moving parts of the dispenser are shown, for the sake of clarity.

When the operating knob 8 is drawn out counter to the action of the spring in the bearing sleeve, the spindle end 10 accompanies it, and the bearing flange 12 strikes against a portion 24 on the upper part 21 of the annular rocking means 18. The rocking means 18 is rockable about the pin 25 which is mounted on the bearing sleeve 11 (not shown in FIG. 3). When the roll in use position is empty or virtually empty, the locking heel 19 can pivot in under the roll and allow the rocking means to rock counterclockwise in FIG. 3. During this rocking movement, the upper part 21 of the rocking means will strike against the lower end 26 of the link arm 22 and take this end along in a pivoting movement about the pin 27 counter to the action of a spring 28. In the retaining position of the retaining means, the upper end 29 of the link arm 22 is in locking engagement with a locking catch 30, and the link arm in this way holds the retaining means 17 in retaining position with the support pins horizontal as in FIG. 3 and in a position to be capable of supporting a reserve roll arranged on them. In the illustrative embodiment shown, the support pins 16 are connected rigidly to a central strut 31, on which the locking catch 30 is arranged.

When the link arm is taken along in a pivoting movement by means of the rocking means 18 when the operating knob is drawn out, the upper end of the link arm 22 will come out of locking engagement with the locking catch on the retaining means. The central strut 31 of this is mounted rotatably in the casing 2, as can be seen from FIG. 1, and the support pins 16 will drop like a trapdoor by virtue of the action of the weight of a reserve roll when the link arm comes out of locking engagement with the locking catch. Arranged on the central strut 31 is a torsion spring 32 which is tightened when the support pins drop down under the weight of the reserve roll and returns the support pins to support position when the roll has passed. When the operating knob is released, it will, as mentioned above, return automatically to its normal position and insert the spindle end 10 into the new roll. The rocking means 18 rocks back by virtue of the action of the torsion spring on the pin 23 of the locking heel 19. When the spindle end 10 and the bearing flange 12 are inserted into the central core of the new roll, the link arm 22 is freed, and its upper end 29 goes back into locking engagement with the locking catch by virtue of the action of the spring 28.

As can be seen from FIG. 1, the casing 2 is provided with an opening 33, through which it is possible to observe whether and how much paper remains in use position. The associated cover (not shown) is provided with transparent portions directly in front of said opening 33. The cover is also suitably provided with a transparent portion directly in front of the opening 15 in the casing, through which it is possible to see whether a reserve roll is in place. The material used for the cover can furthermore be coloured plastic or sheet metal. Alternatively, the whole cover can of course be transparent.

The size of the housing formed by the wall bracket and the casing is adapted to the roll of material. It is of course important that a falling new roll passes into the first space, that is to say comes to lie in the correct place in use position in such a way that the spindle end can enter the core of the roll. In a construction with a bearing flange, however, a relatively great tolerance is permissible. The bearing flange guides the core into the correct position. The construction described above also allows tolerances in the width of the roll of material and also for the roll to be slightly lopsided. To this end, the rocking means has a certain free play between the bearing flange on the spindle end and the lower end 26 of the link arm 22.

The casing 2 can be provided on its inside with friction means in the form of one or more inwardly protruding projections (not shown) in order to brake the fall of the reserve roll down into use position.

The invention is not limited to the embodiment described above but a number of modifications are possible within the scope of the patent claims below.

What is claimed is:

1. Dispenser for rolls of material in the form of a web, selected from the group consisting of paper, non-woven fabric, film and foil, which dispenser comprises a housing with a withdrawal opening arranged at the bottom for the material in the form of a web, the housing having space for at least two rolls which are arranged with their centre axes lying essentially horizontally, a first space being arranged adjacent to the withdrawal opening and being intended for a roll in use position, and a second space being located above the first space and being intended for a roll in reserve position, in addition to which a retaining means is arranged so as, in a retaining position, to hold the second roll in reserve position, the retaining means being arranged so as to be freed in order to allow the reserve roll to drop down into use position when the first roll is removed, wherein a spindle end is arranged in the first space in the housing, which spindle end is displaceable in its longitudinal direction and rotatably mounted, is intended to lie in engagement with the interior of a central core of a roll in use position and is connected to an operating knob arranged outside the housing, by means of which knob the material web can be fed out of the withdrawal opening and by means of which the spindle end can be drawn out of engagement with the central core, and means are arranged so as to free the retaining means when the spindle end is drawn out of engagement with the central core of a roll in use position and to bring the retaining means back into retaining position when the spindle end is brought into engagement with the interior of the central core of a new roll in use position.

2. Dispenser according to claim 1, wherein the spindle end has a radially projecting flange which is arranged so as to serve as a bearing flange and lie in engagement with the interior of the central core of a roll arranged in use position.

3. Dispenser according to claim 2, wherein said bearing flange is arranged so as to serve as said portion which is intended to be brought into engagement with the upper part of the rocking means.

4. Dispenser according to claim 1, wherein the spindle end is arranged so as to be drawn manually out of the core of a finished roll by means of the operating knob counter to the action of a spring, the latter being arranged so as automatically to guide the spindle end into engagement with the central core of a new roll introduced into use position.

5. Dispenser according to claim 1, wherein the spindle end has a portion which, when the spindle end is drawn out, strikes against the upper part of the rocking means and takes the latter along in said rocking movement.

6. Dispenser according to claim 1, wherein said means include a rocking means which is arranged around the spindle end and arranged rockably about a horizontal rocking pin extending at right angles to said spindle end, the upper part of the rocking means is arranged so as to be taken along in a rocking movement by the spindle end when the latter is drawn out of engagement with the central core, and the upper part of the rocking means is arranged so as to interact with a link mechanism which is in turn arranged so as to free the retaining means when said drawing-out of the spindle end takes place and to lock the retaining means again when the spindle end is guided into engagement with the interior of the core of a roll arranged in the use position.

7. Dispenser according to claim 6, wherein the rocking means has on its lower part a locking heel which projects in the direction of a roll arranged in use position and is arranged so as to interact with a roll in use position, one edge side of the roll limiting, until the roll is virtually finished, the pivoting of the rocking means when the locking heel strikes against said edge side of the roll, and said locking heel is arranged so as to prevent said rocking movement and thus the drawing of the spindle end out of the core of the roll in use position until the roll is virtually finished and the locking heel has space to pass in under the virtually finished roll.

8. Dispenser according to claim 7, wherein the locking heel is arranged so as to be pivotable downwards from its laterally projecting state in relation to the rest of the rocking means counter to the action of a spring, as a result of which the locking heel can be pivoted aside about its pivoting pin when it is acted on by the weight of a new roll of full size dropping down into the use position, and the locking heel is arranged so as, by virtue of the action of said spring, to return to its projecting state and in doing so rock the rocking means back out of engagement with the link mechanism when the spindle end is guided into engagement with the interior of the central core of the roll located in use position, the retaining means being arranged so as to return to retaining position to support a new roll in reserve position.

9. Dispenser according to claim 6, wherein the link mechanism includes a link arm which is pivotable about a horizontal pin, is arranged so as by its upper end to support a locking catch and to hold the retaining means in retaining position and is arranged so as, counter to the action of a spring, to be brought out of engagement with the locking catch when the rocking means takes the lower end of the link arm along in a pivoting movement when the spindle end is drawn out of a core of a finished roll.

10. Dispenser according to claim 9, wherein the retaining means is arranged so as, counter to the action of a spring, to drop like a trapdoor under the weight of a roll in reserve position when the link arm is brought out of engagement with the locking catch and, by virtue of the action of said spring, to return to its retaining position when the roll has dropped past the retaining means.

* * * * *